United States Patent [19]

Jennings

[11] 4,005,282

[45] Jan. 25, 1977

[54] DECOMETER

[75] Inventor: Kirk E. Jennings, Kaneohe, Hawaii

[73] Assignee: The United States of America as represented by the Secretary of the Navy, Washington, D.C.

[22] Filed: Sept. 25, 1975

[21] Appl. No.: 616,786

[52] U.S. Cl. ..... 235/151.3; 73/432 R; 128/2.1 R; 235/151.32

[51] Int. Cl.[2] ..... G06F 15/42

[58] Field of Search ..... 235/151.3, 151.32, 184; 73/170 R, 170 A, 432 R; 128/2 R, 2.1 R, 204; 444/1

[56] References Cited

UNITED STATES PATENTS

| | | | |
|---|---|---|---|
| 3,415,247 | 12/1968 | Louvel et al. | 128/204 |
| 3,457,393 | 7/1969 | Stubbs et al. | 128/2.1 R X |
| 3,681,585 | 8/1972 | Todd | 235/184 |
| 3,746,850 | 7/1973 | Moore et al. | 235/184 |
| 3,886,801 | 6/1975 | Hills | 73/432 R |

OTHER PUBLICATIONS

L. Altman, "Single-Chip Microprocessors Open Up a New World of Applications", Electronics, Apr. 18, 1974, pp. 81–87.

*Primary Examiner*—Jerry Smith
*Attorney, Agent, or Firm*—Richard S. Sciascia; Ervin F. Johnston; John Stan

[57] ABSTRACT

A portable decompression computer, which is capable of providing a diver's current depth and safe-ascent depth, comprising a source of energy, for energizing various components of the computer. A micro processor is energized by the energy source. A clock generator times various components of the computer. A bus driver and status latch, timed by the clock generator and connected to the micro processor, decodes data signals received at its input and converts them to compatible voltage levels as output signals. The status latch decodes information from the micro processor and relays it to various memory input and output devices. A read-only memory (ROM), which has the main programs for the computer stored within it, can be addressed programmatically by the micro processor. A first random-access memory (RAM), connected to the micro processor, can write data into and be read by the bus driver and status latch, the memory storing the program variables. A pressure sensor and A/D converter which multiplexes depth information onto the bus driver and status latch. A second random-access memory receives information on a read-write bus regarding the current depth and safe ascent depth and stores it. A display and multiplexer has as an input the current depth and safe ascent depth, its function being to decode the address of the digit selected and determine the time on, or duty cycle, of each digit, and to display the digit.

8 Claims, 6 Drawing Figures

DECOMETER BLOCK DIAGRAM

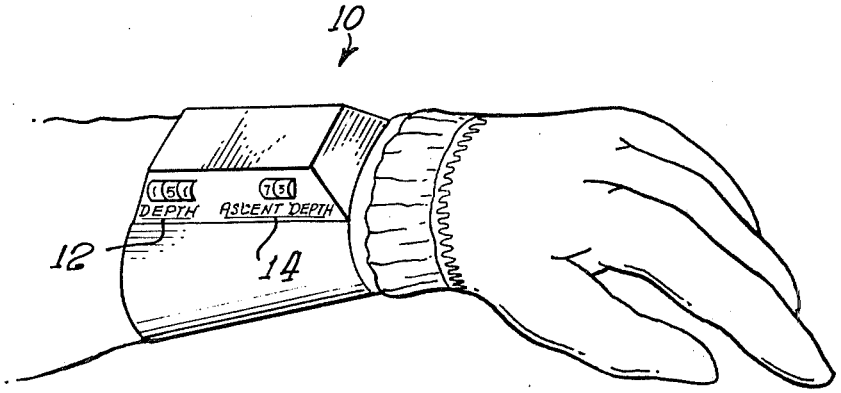
FIG. 1.
DECOMETER IN POSITION
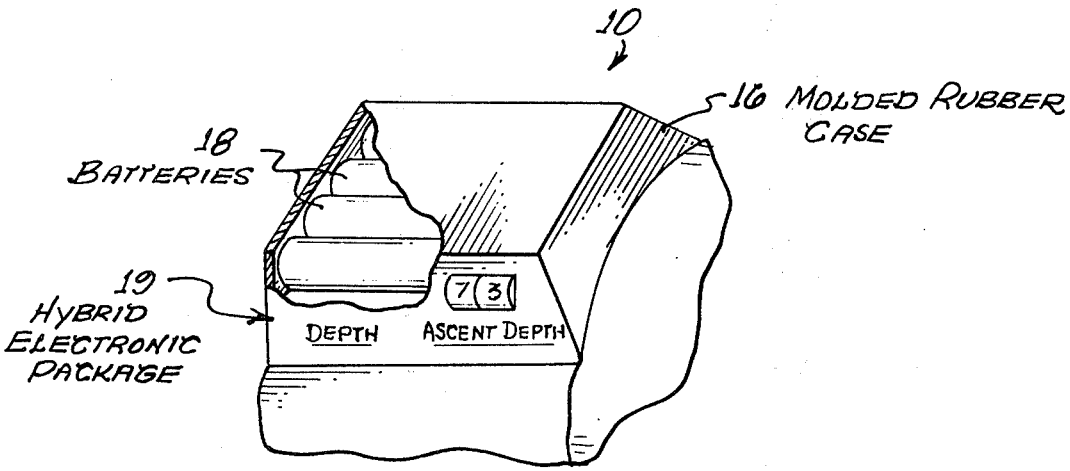
FIG. 2. MAIN COMPONENTS OF DECOMETER

DECOMETER BLOCK DIAGRAM

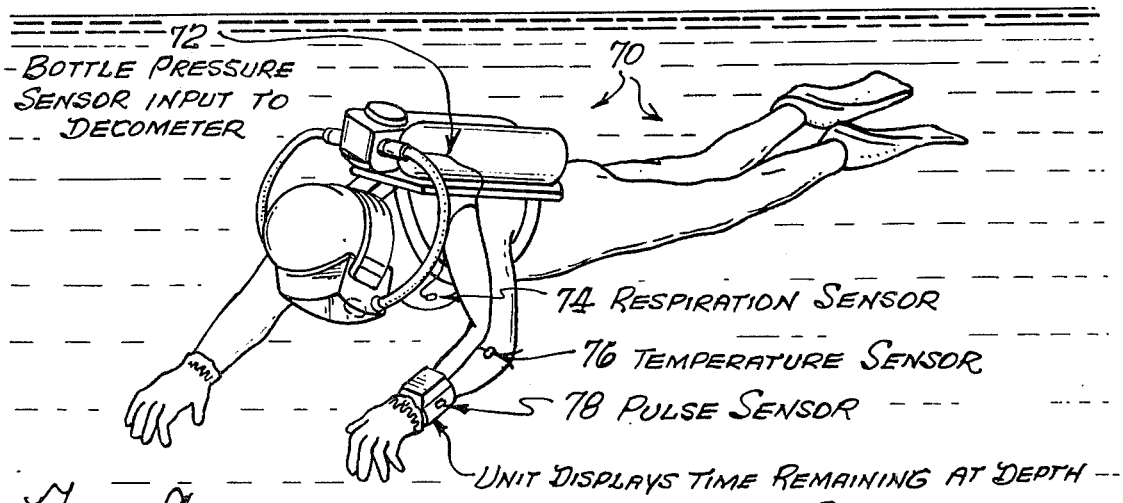
FIG. 4. DECOMETER IN USE WITH OTHER BODY SENSORS.
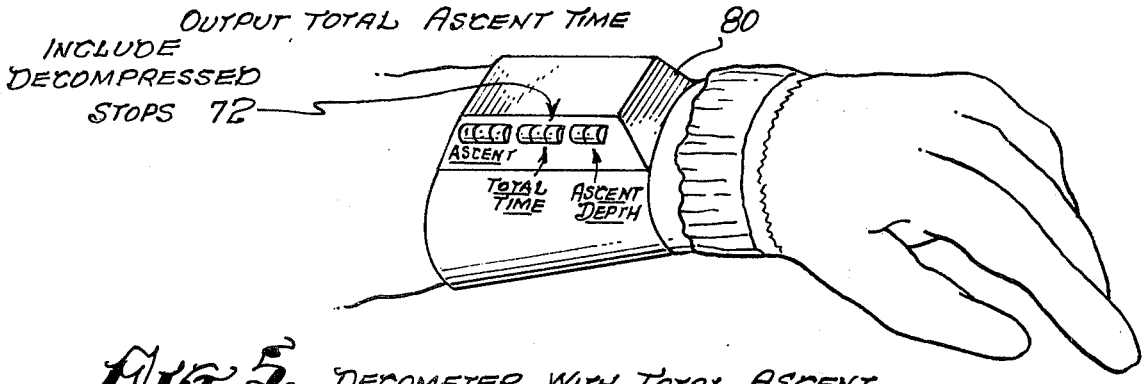
FIG. 5. DECOMETER WITH TOTAL ASCENT TIME FEATURE
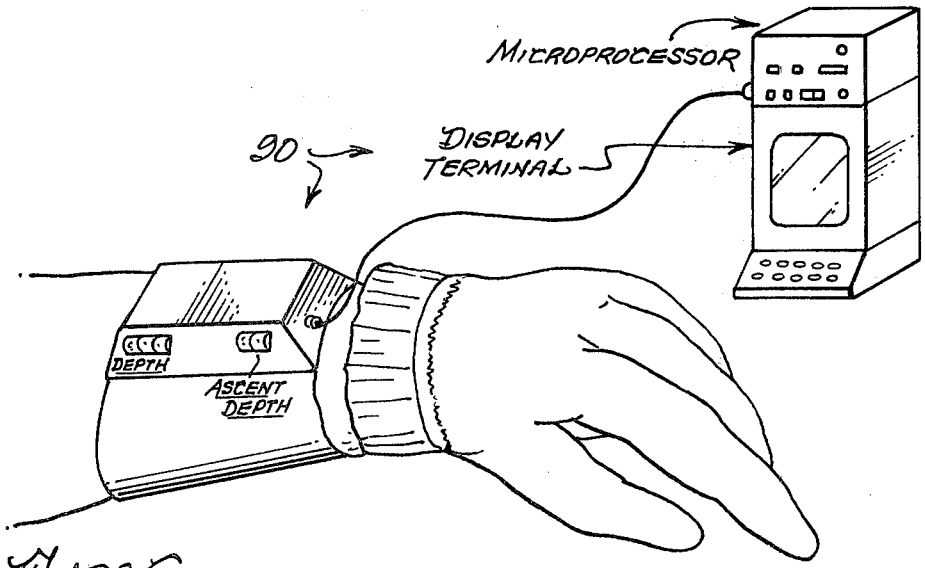
FIG. 6. DISPLAY TERMINAL AND MICROPROCESSOR CONNECTED TO DECOMETER AFTER A COMPLETED DIVE DISPLAY. DIVE VS. TIME

DECOMETER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Divers must constantly be aware of the physiological changes brought about in their bodies due to increased pressures. Gases are absorbed in body tissues when the body is exposed to increased pressures. Typically, nitrogen is of primary concern to most divers; however, helium or some other inert gas between the alveolar parts and tissues causes the tissues to absorb or desorb gases. The time for body tissues to reach equilibrium with alveolar gas content for a particular gas is the tissue saturation time and is dependent on the tissue half-time. Tissues that have a large blood supply relative to their mass may saturate more rapidly than those with a poor blood supply.

As the tissue inert gas level rises, the partial pressure difference is decreased until equilibrium is reached. During a dive, some of the diver's tissues become saturated and the diver's body will contain more dissolved nitrogen than he normally has when on the surface. During ascent, the dissolved nitrogen must desaturate. The time for desaturation, like saturation, depends on which tissues have been saturated. Therefore, the length of time at a specific depth becomes essential in determining the surfacing rate. A diver who surfaces faster than the body can normally desaturate or eliminate the dissolved gases, will form small bubbles in his tissues. Basically, this is because the circulatory system cannot expel the dissolved gases at the rate at which the external body pressure is decreased. The dissolved gases at this point no longer can stay in solution. The formation of these bubbles is referred to as decompression sickness or "the bends". Decompression sickness can cause permanent injuries or be fatal.

Because of the possibility of "the bends", it is essential that a diver keep an accurate account of his diving status. Presently, most dives are planned prior to entering the water. The Navy Standard Dive Tables are used to calculate the limits for time and depth of dives. Divers can easily plan no-decompression dives or determine necessary decompression stops required to desaturate the body.

There are several apparent disadvantages in using this procedure. Since it would be impractical or impossible for divers to calculate safe limits for dives of varying depths, the diving tables utilize the deepest point of the dive as if the entire time were spent there. As an example, a diver who spends 30 minutes at 90 feet (square dive) must surface or it will be necessary for him to decompress. However, a diver who spends 5 minutes at 90 feet, 10 minutes at 50 feet, 20 minutes at 70 feet, and 5 minutes at 30 feet also must surface in 30 minutes according to the Navy Standard Dive Tables, or it will be necessary for him to decompress. It is obvious that this diver has not reached the same decompression state or dilutant gas tissue partial pressures as the first diver. In this extreme example, the diver would be required to surface sooner than necessary. In most dives, a non-square dive profile is desirable. Therefore, in many instances, divers are required to surface sooner than necessary. The diver-carried decompression computer of this invention continually monitors the diver's decompression status for varying depths.

The decometer would also be valuable to divers who: (1) deviate from the dive plan; (2) operate mixed-gas deep dives; (3) cannot pre-plan due to mission requirements; (4) are on a repetitive dive task; or (5) are working in situations where submerged time is very valuable. The mathematical model followed by the decometer is the same used in calculating the Navy Dive Tables. The Navy's allowable tissue tensions, see Table I, are put in as a look-up table. Each of the current tissue tensions are compared with the table to give the safe ascent output.

TABLE 1

| DEPTH (FEET) | MAXIMUM ALLOWABLE TISSUE TENSIONS OF NITROGEN FOR VARIOUS HALF-TIME TISSUES TISSUE HALF TIMES (MINUTES) STORED IN DECOMETER LOOK-UP TABLE | | | | | | | | |
|---|---|---|---|---|---|---|---|---|---|
| | 5 | 10 | 20 | 40 | 80 | 120 | 160 | 200 | 240 |
| 10 | 104.280 | 88.120 | 71.950 | 58.400 | 52.140 | 50.050 | 49.790 | 48.490 | 46.930 |
| 20 | 126.020 | 107.360 | 88.460 | 72.390 | 64.910 | 62.400 | 62.090 | 60.510 | 58.630 |
| 30 | 149.270 | 127.470 | 105.340 | 86.480 | 77.660 | 74.710 | 74.340 | 72.490 | 70.260 |
| 40 | 172.660 | 147.610 | 122.160 | 100.450 | 90.300 | 86.890 | 86.470 | 84.330 | 81.760 |
| 50 | 195.930 | 167.620 | 138.850 | 114.290 | 102.800 | 98.950 | 98.460 | 96.050 | 93.140 |
| 60 | 219.030 | 187.470 | 155.390 | 128.000 | 115.180 | 110.880 | 110.340 | 107.640 | 104.390 |
| 70 | 241.960 | 207.160 | 171.790 | 141.580 | 127.440 | 122.690 | 122.100 | 119.120 | 115.540 |

Electronically, the instrument senses the pressure of a solid state pressure transducer and inputs this information to a digital micro processor which computes current depth and safe-ascent depth. This information is displayed on a digital readout employing light-emitting diodes. In this fashion, the display indicates even in darkened waters with a minimum chance of misinterpretation. If the mathematical limits of the model which the computer runs are exceeded, the computer is programmed to output a flashing "FU" in place of the safe-ascent depth. Flashing decimal points in all digital positions indicate a low battery condition or safe-ascent depth exceeded.

SUMMARY OF THE INVENTION

A wrist-carried diver's digital decompression computer, herein termed a decometer, senses the depth at which a swimmer is located by sensing the water pressure acting on the back of the instrument, which employs a solid-state strain transducer. An analog-to-binary circuit converts the strain transducer's output to 8 bits of binary information, which is electrically presented to the input port of a micro processor, through a bus driver and status latch. The micro processor, programmed to run the U.S. Navy Decompression Tables, takes the depth input, computes the residual nitrogen in a "nine tissue" model, compares these computed values to a look-up table (consisting of the Navy's allowable "M" values) and provides a digital display to the diver of the safeascent depth and the diver's current depth.

The size of the device is approximately equal to a pack of king-size cigarettes. High energy-density batteries provide power for the unit to last approximately 12 hours.

STATEMENT OF THE OBJECTS OF THE INVENTION

It is accordingly an object of this invention to provide an improved decompression device for divers, or hyperbaric facilities in larger size.

A further object of this invention is to provide a decompression device for use in underwater environments.

Another object of this invention is to provide a decompression device with a readout which may be easily read in darkened waters.

A still further object is to provide a decompression computer with a "staged ascent" as per the Navy Dive Tables.

Yet another object is to provide a decompression computer which can compute "air" or "mixed gas" dives.

BRIEF DESCRIPTION OF THE DRAWINGS

FIG. 1 is a perspective view of the face of the decometer in position on a diver's wrist.

FIG. 2 is a breakaway view showing the main components of the instrument.

FIG. 4 is a pictorial view of a decometer in use with other body sensors.

FIG. 5 is a pictorial view of a decometer having the capability of displaying the total ascent time.

FIG. 6 is a pictorial, diagrammatic, view of the decometer connected to a display terminal and another microprocessor used with the display terminal.

Description of the Preferred Embodiments

Figure 3:
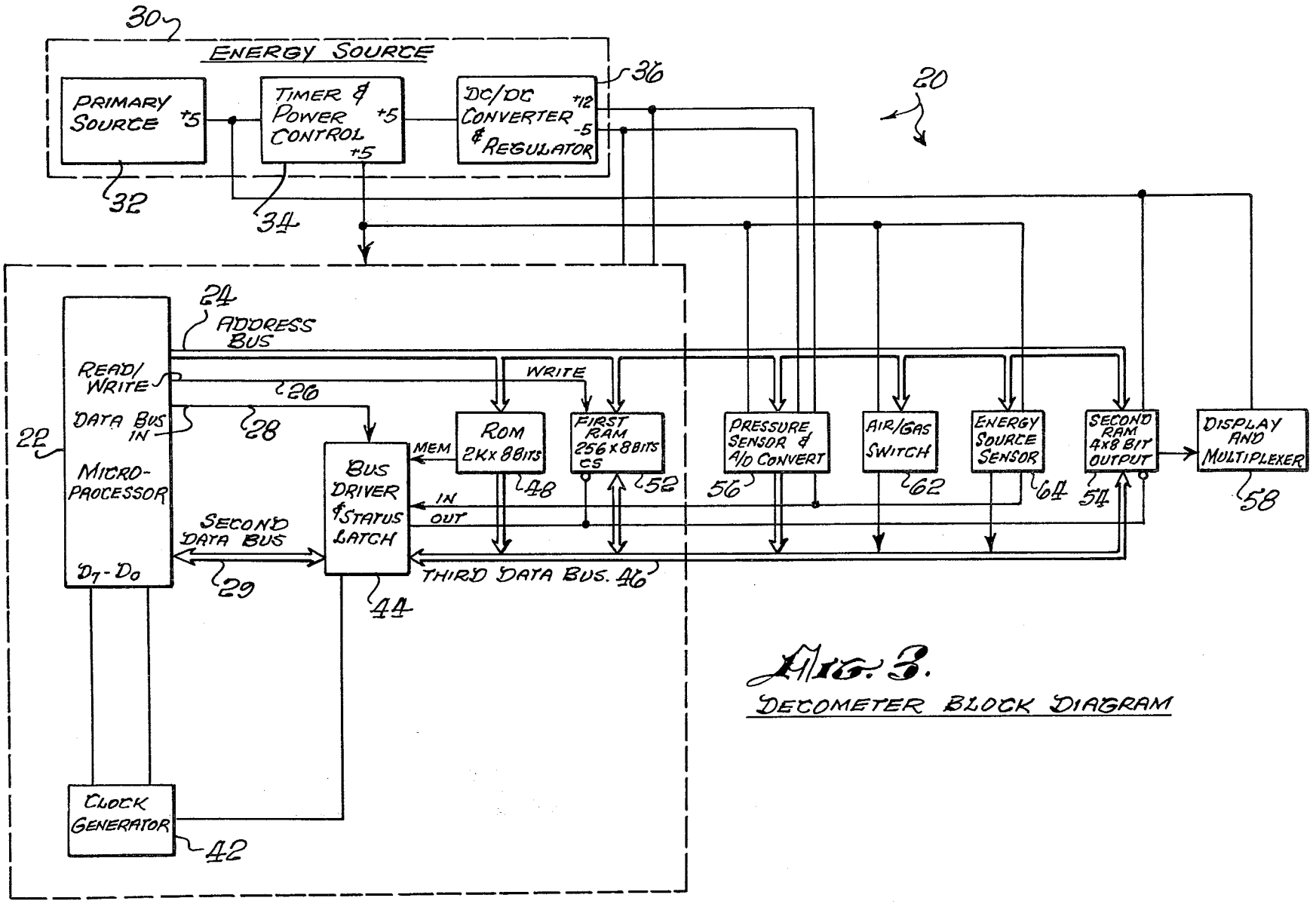
FIG. 3 is a diagrammatic, block, view of the circuitry comprising the electronic portions of the decometer.

FIGS. 1 and 2 show the main features and components of the decometer 10. The depth 12 and ascent depth 14 are shown as numerals in the basic instrument.

The decometer 10 comprises a molded rubber case 16, within which are enclosed batteries 18 and a hybrid electronic package 19.

The primary batteries may be lithium oxide batteries. These were chosen for their high energy density and long shelf life. A battery of this type provides approximately six volts of continuous power for the system timer and power control circuit, the four by eight-bit random access memory (RAM), and the display and display multiplexer.

Referring now to FIG. 3, therein is shown a block diagram of a portable decompression computer 20, which is capable of providing a diver's current depth and safe ascent depth, comprising a source of energy 30 for energizing various components of the computer. The source of energy 30 may comprises a primary source, such as a battery 32. A timer and power control circuit 34, whose input is connected to the battery 32, controls distribution of power to the components of the computer 20. A DC/DC converter and regulator 36, whose input is connected to the timer and power control 34, chops the incoming voltage from the timer and power control to generate higher positive and negative voltages needed by some of the components.

The system timer and power control circuit 34 controls distribution of power to the rest of the system 20. The purpose of the system timer and power control circuit 34 is: to generate an accurate 2-second, iteration, cycle; generate a zero for a cold start (start of dive), and a one for a warm start (subsequent cycles), the cold start initializing the partial pressures in the model; provides power to the DC/DC converter and regulator 36 for the time the computer 20 is running; supplies power to the DC/DC converter and regulator 36, and turns power off when signalled by the computer 20 that an end of an interation cycle has been reached.

A main component of the computer 20 is a micro processor 22, which is energized by the energy source 30, and connected to an address bus 24, a read-write bus 26, a data bus in 28, and a second data bus 29. The timer and power control provides a three-cycle delay in the restart command to the micro processor 22, which insures the clearing of the micro processor's accumulator and storage registers.

A clock generator 42 times various components of the computer 20.

A bus driver and status latch 44, timed by the clock generator 42 and connected by the second data bus 29 to the micro procesor 22, decodes data signals received from its input and converts them to compatible voltage levels for the second data bus 29, and a third data bus 46, the status latch decoding information from the micro processor and relaying it to various memory and output devices.

A read-only memory (ROM) 48, which has the main programs for the computer 29 stored within it, can be addressed programtically by the micro processor 22. It makes its stored data available on the third data bus 46, connected to the bus driver and status latch 44. The 2K × 8-bit read only memory (ROM) is a metal mask ROM. The ROM's power is completely turned off after the end of an iteration cycle, and turned on at the start of an iteration cycle. This can be done because the information stored within the unit is non-volatile.

A first random-access memory (RAM) 52 can be written into by the read-write bus 26 connected to the micro processor 22, and can write data into and be read by the bus driver and status latch 44 by means of the third data bus 46. The memory 52 stores the program variables. The information is volatile by nature and power control of the unit saves the information during non-use intervals.

The micro processor 22 can be locked at as a programmable logic array. It is an eight-bit parallel data processor which processes the data fed to it by the read-only memory, having a capacity of 2K × 8 bits, and stores its variables in the first random access memory (RAM) 52. It outputs the safe-ascent depth and current depth in the 4 × 8-bit output of the second random-access memory 54. Timing is accomplished by the two-phase clock generator 42, and status information is decoded by the bus driver and status latch 44. Selection of various devices surrounding the micro processor 20 is accomplished by a combination of the address bus 24 and status latch 44.

The timer and power control 34 controls power to the 256 × 8-bit random access memory 52 to provide full power to this unit when it is accessed by the micro processor 22, and reduces power when the computer iteration cycle is finished. This maintains the integrity of the data stored in the random access memory 52, but cuts power drain by a factor of 100.

A pressure sensor and A/D converter 56 multiplexes depth information in 8-byte bits onto the third data bus 46, to the bus driver and status latch 44. The pressure sensor 56 is a bridged semiconductor strain deposited on a vacuum reference cell. This unit 56 has its own regulator. It receives +12 and −5 volts from the DC/DC converter and regulator 36, so that its output varies from 0 to 10 volts. The output of the strain gage is temperature-compensated, amplified and sent to the 10-bit monolithic A/D converter of the unit 56. The A/D converter is a 10-bit successive approximation unit which incorporates a tristate output bus. The A/D converter is started on command from the micro processor 22, which interrogates its busy line until the A/D unit indicates not busy and then pulls in the data presented.

The DC/DC converter and regulator 36 chops the incoming voltage from the timer and power control circuit 34 and provides the higher positive and negative voltages needed by the micro processor 22, the clock generator 42 and the pressure sensor and the A/D converter 56. The power control circuit 34 also provides the regulated voltage required by the pressure sensor and A/D converter 56.

The second random-access memory 54 receives information on the address bus 24 from the read-write bus 26 regarding the current depth and safe ascent depth and stores it. It is a word addressable memory.

A display and multiplexer 58, which is energized by the source of energy 30, has as an input from the second random access memory 54 the current depth and safe ascent depth. It receives timing pulses from the timer and power control circuit 34, the function of the display and multiplexer being to decode the address of the digit selected and determine the time on, or duty cycle, of each digit. Thus, only one digit is lit at any given time.

The computer 20 may further comprise an air-gas switch 62, which can be addressed by the micro processor 22, which determines in which mode, air or mixed gas, that the diver wants to run the computer. The air/gas switch 62 is a manually activated device. It involves changing the magnetic density in a "half-effect device" which sends a transistor-transistor logic (TTL) compatible signal upon interrogation to the micro processor 22. This selection can be made by the diver during the dive as to what mode, — air or mixed gas — he wants to run the decometer in.

The computer 22 may further include an energy-source sensor 64, which can be addressed by the micro processor 22 and which can write through the third data bus 46 into the bus driver and status latch 44 the condition of the energy source.

Power to the air/gas switch and the energy-source sensor is supplied by the system timer and power control circuit. When the primary source 32 is a battery, the sensor 64 senses the primary battery voltage, and sends its status to the micro processor 22.

As is shown in FIG. 4, the decometer can be configured to include a bottle pressure sensor 72, output the time the diver can remain at his present depth based on average breathing rate in water and ambient pressure and temperature. This would involve use of respiration, temperature and even a pulse sensor, 74, 76 and 78. This would account for the differences between a working diver and a sports diver, cold vs. warm water, etc.

In another embodiment, the instrument 80 could output the total surfacing time, which would include decompression stops and a 60 foot/min ascent rate, on a display 72.

The apparatus 90 can display the dive profile. This involves sequentially storing the depth information. This information would be useful knowledge to a doctor treating the diver if he were sick.

An auxiliary battery pack could be used for time extended dives.

The decometer can be programmed to accommodate any gas mixture, i.e. air, $NO_2$ or selected $HeO_2$ mixture.

Other alternates include - batteries, switching circuitry, read-out display and packaging.

Obviously many modifications and variations of the present invention are possible in the light of the above teachings. It is therefore to be understood that within the scope of the appended claims the invention may be practiced otherwise than as specifically described.

What is claimed is:

1. A portable decompression computer, which is capable of providing a diver's current depth and safe ascent depth, comprising:

a source of energy, for energizing and timing various components of the computer;

a micro processor, energized by the energy source, connected to an address bus, a read-write bus, a data bus in, and a second dated bus;

a clock generator for timing various components of the computer;

a bus driver and status latch, timed by the clock generator and connected by the data bus in and the second data bus to the micro processor, which decodes data signals received from the micro processor and converts them to compatible voltage levels for the second and a third data bus, the status latch decoding information from the micro processor and relaying it to various memory input and output devices;

a read-only memory (ROM), which has the main programs for the computer stored within it which can be addressed programmatically by the micro processor, and which makes its stored data available on the third data bus, connected to the bus driver and status latch;

a first random-access memory (RAM), which can be written into by the read-write bus connected to the micro processor, which can write data into and be read by the bus driver and status latch by means of the third data bus, the memory storing program variables;

a pressure sensor and A/D converter which multiplexes depth information onto the third data bus;

a second random-access memory, which receives information on the address bus from the read-write data bus regarding the current depth and safe ascent depth and stores it; and a display and multiplexer which is energized by the source of energy, has as an input from the second random access memory the current depth and safe ascent depth, and receives timing pulses from the source of energy, the function of the display and multiplexer being to decode the address of the digit selected and determine the time on, or duty cycle, of each digit.

2. A portable decompression computer, according to claim 1 wherein the source of energy comprises:

a battery;

a timer and power control circuit, whose input is connected to the battery, which controls distribution of power to the components of the computer; and a DC/DC converter and regulator, whose input is connected to the timer and power control, which chops the incoming voltage from the timer and power control to generate higher positive and negative voltages needed by some of the components.

3. The computer according to claim 1, further comprising:

an air-gas switch, which can be addressed by the micro processor, which determines in which mode, air or mixed gas, that the diver wants to run the computer.

4. The computer according to claim 1, further comprising:

an energy-source sensor which can be addressed by the micro processor and which can write through the third data bus into the bus driver and status latch the condition of the energy source.

5. Indicating apparatus, useful for a driver comprising:

means for sensing pressure, and therefore depth;

timing means;

means for storing safe time-depth data, to prevent the bends of a diver, at various depths for various times;

read-out means for displaying a depth; and computer processing means connected to the pressure sensor means, timing means, storing means, and read-out means for first computing and then displaying on the read-out means a safe ascent depth;

the computer processing means comprising a micro processor, which receives the depth pressure information from the pressure sensing means, total time submerged at the various times from the timing means, and safe time-depth data from the storing means and computes therefrom the said safe-ascent depth in a manner so as to maximize the amount of time the diver can safely stay underwater.

6. The indicating apparatus according to claim 5, wherein the pressure sensor means comprises a pressure transducer which also senses ambient depth of water; and the means for storing safe time-depth data comprises a read-only memory 7. The indicating apparatus according to claim 6 wherein the computer processing means further comprises means connected to the micro processor, for controlling the flow of data to and from the micro processor, and from the read-only memory.

8. The indicating apparatus according to claim 7, wherein the computer processing means further comprises:

a first means for storing information which can be written into and read out by the micro processor, which stores required program variables, including depth and time; and a second means for storing information, which receives information from the micro processor regarding the current depth and safe depth, stores it, and transmits it to the read-out means for display.

* * * * *